US006454599B1

(12) United States Patent
Wu

(10) Patent No.: US 6,454,599 B1
(45) Date of Patent: Sep. 24, 2002

(54) ELECTRICAL CONNECTOR HAVING GROUNDING BRIDGES

(75) Inventor: Jerry Wu, Pan-Chiao (TW)

(73) Assignee: Hon Hai Precision Ind. Co., Ltd., Taipei Hsein (TW)

( * ) Notice: Subject to any disclaimer, the term of this patent is extended or adjusted under 35 U.S.C. 154(b) by 0 days.

(21) Appl. No.: 09/938,442

(22) Filed: Aug. 23, 2001

(51) Int. Cl.[7] ..... H01R 13/73; H01R 4/66
(52) U.S. Cl. ..... 439/567; 439/108
(58) Field of Search ..... 439/101, 108, 439/567, 571, 572, 607, 570

(56) References Cited

U.S. PATENT DOCUMENTS 5,085,599 A * 2/1992 Kan ..... 439/567
5,727,970 A * 3/1998 Koguch et al. ..... 439/108
5,865,645 A * 2/1999 Embo et al. ..... 439/567
5,951,325 A * 9/1999 Tang et al. ..... 439/567
6,086,418 A * 7/2000 Chang ..... 439/567
6,095,853 A * 8/2000 Huang et al. ..... 439/567
6,135,789 A * 10/2000 Lai et al. ..... 439/567

* cited by examiner

*Primary Examiner*—Gary F. Paumen
(74) *Attorney, Agent, or Firm*—Wee Te Chung

(57) ABSTRACT

A connector includes a housing (1), a plurality of electrical contacts (2) and a pair of grounding bridges (3). The housing has two opposite engaging arms (17) each having a post (174) formed thereon. A pair of mounting channels (162) is defined in two ends of the housing. First and second grooves (172, 171) are defined in an outside of the engaging arm. The grounding bridges each comprise a first leg portion (31) interferingly engaging into the channel, and a second leg portion (32) having a first flange (38) engaged with the first groove and a second flange (390) abutting against a front face of the engaging arm.

1 Claim, 4 Drawing Sheets

ELECTRICAL CONNECTOR HAVING GROUNDING BRIDGES

BACKGROUND OF THE INVENTION

1. Field of the Invention

The present invention relates to an electrical connector mounted on a printed circuit board, and particularly to an electrical connector having improved housing and grounding bridge.

2. Brief Description of the Prior Art

Electrical connectors generally include a pair of grounding bridges which mount the connector on a printed circuit board (PCB) and which then are soldered on the PCB by SMT. Traditionally, the grounding bridge is engaged into a housing of the connector and is suspended over the connector, such that it is easy to be deformed by unexpected external force.

The electrical connector also includes a pair of posts which are inserted into holes formed in the PCB to fix the connector at certain position. Traditionally, the connector housing is formed by molding operation. The mold for forming the housing is moving in the same direction as the mating direction of a complementary connector. In conventional design, the posts are formed by slide molds which are moving in a direction ordinarily perpendicular to the moving direction of the mold for forming the housing. However, such a design increases the total height of the molds and the molding cost is also increased.

Hence, an improved electrical connector is required to overcome the disadvantages of the prior art.

BRIEF SUMMARY OF THE INVENTION

One object of the present invention is to provide an electrical connector with a pair of grounding bridges which is not easy to be deformed by unexpected external force.

Another object of the present invention is to provide an electrical connector adopting core pins for forming a pair of posts thereof which are removed in the same direction in which the mold for forming an insulative housing thereof is removed.

To achieve the above-mentioned objects, a connector in accordance with the present invention includes a housing, a plurality of electrical contacts and a pair of grounding bridges. The housing has a pair of opening, a plurality of passageways, and two opposite engaging arms each having a post formed thereon. The opening and the post are aligned in a direction that the passageways extend. A pair of mounting channels is defined in two ends of the housing respectively. First and second grooves are defined in an outside of each engaging arm. The grounding bridges each comprises a first leg portion interferingly engaging into the channel, and a second leg portion having a first flange engaged with the first groove and a second flange abutting against a front face of the engaging arm.

Other objects, advantages and novel features of the present invention will become more apparent from the following detailed description of the present embodiment when taken in conjunction with the accompanying drawings.

DETAILED DESCRIPTION OF THE INVENTION

Figure 1:
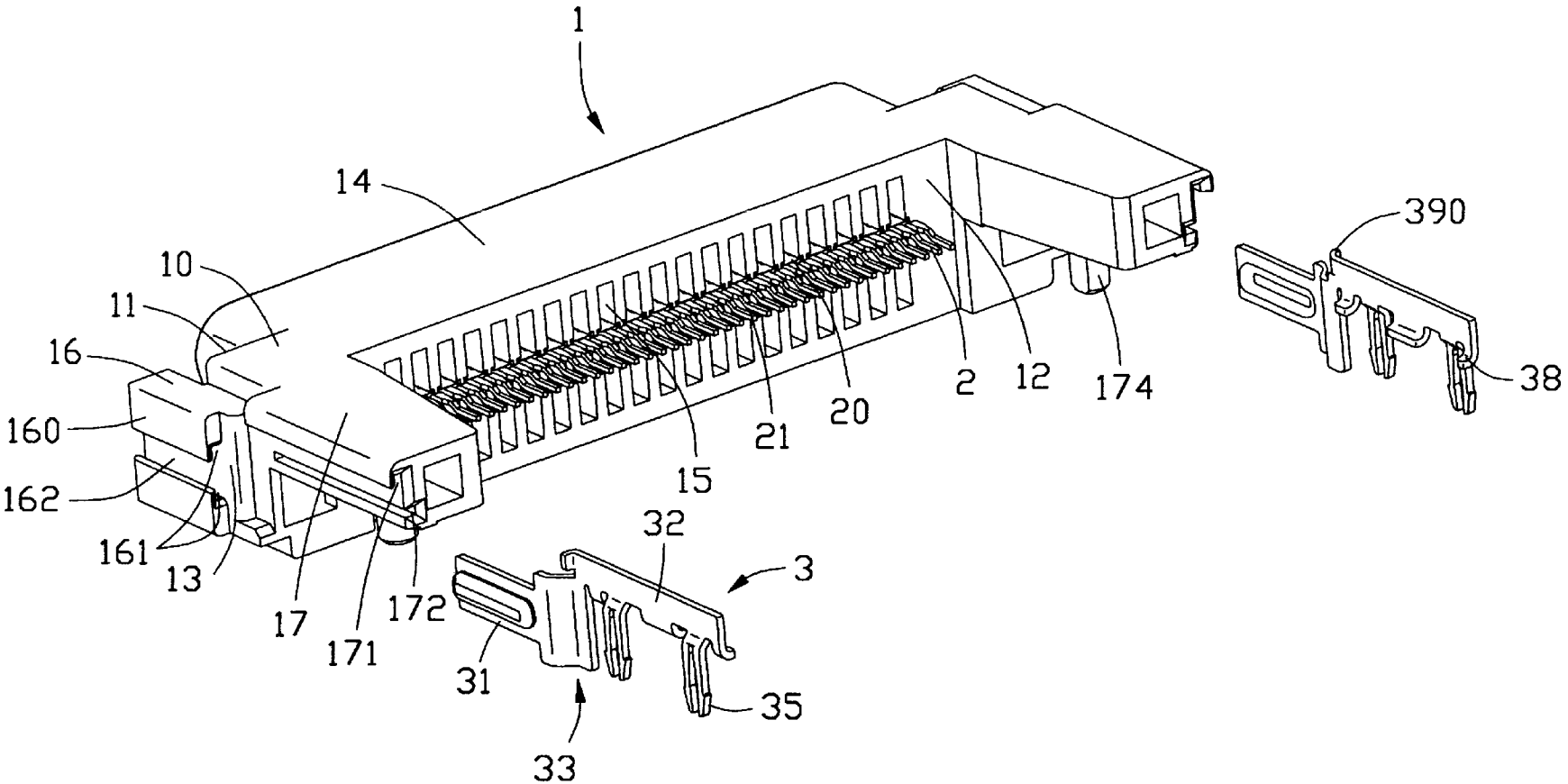
FIG. 1 is a partially-exploded, perspective view of an electrical connector in accordance with the present invention.

Referring to FIG. 1, an electrical connector in accordance with the present invention comprises an insulative housing 1, a plurality of contacts 2 received in the housing 1, and a pair of grounding bridges 3 attached to the housing 1.

The housing 1 comprises an elongated base 10 having a front face 11, a rear face 12 and two opposite side walls 13. A mating portion 14 extends forwardly from the front face 11. A plurality of passageways 15 extends through the base 10 and the mating portion 14 for receiving the contacts 2 therein. Two opposite alignment bars 16 are formed on the respective side walls 13 and extend forwardly. Each alignment bar 16 has a pair of blocks 160, a pair of opposite slots 161 formed in the blocks 160 and communicating with each other to define a mounting channel 162. A pair of elongated engagement arms 17 extends rearwardly from upper portion of two opposite ends of the base 10. Two slit-like grooves 171, 172 are formed on an outer side of each engagement arm 17. The first groove 172 is extending horizontally and the second groove 171 is extending vertically.

Figure 3:
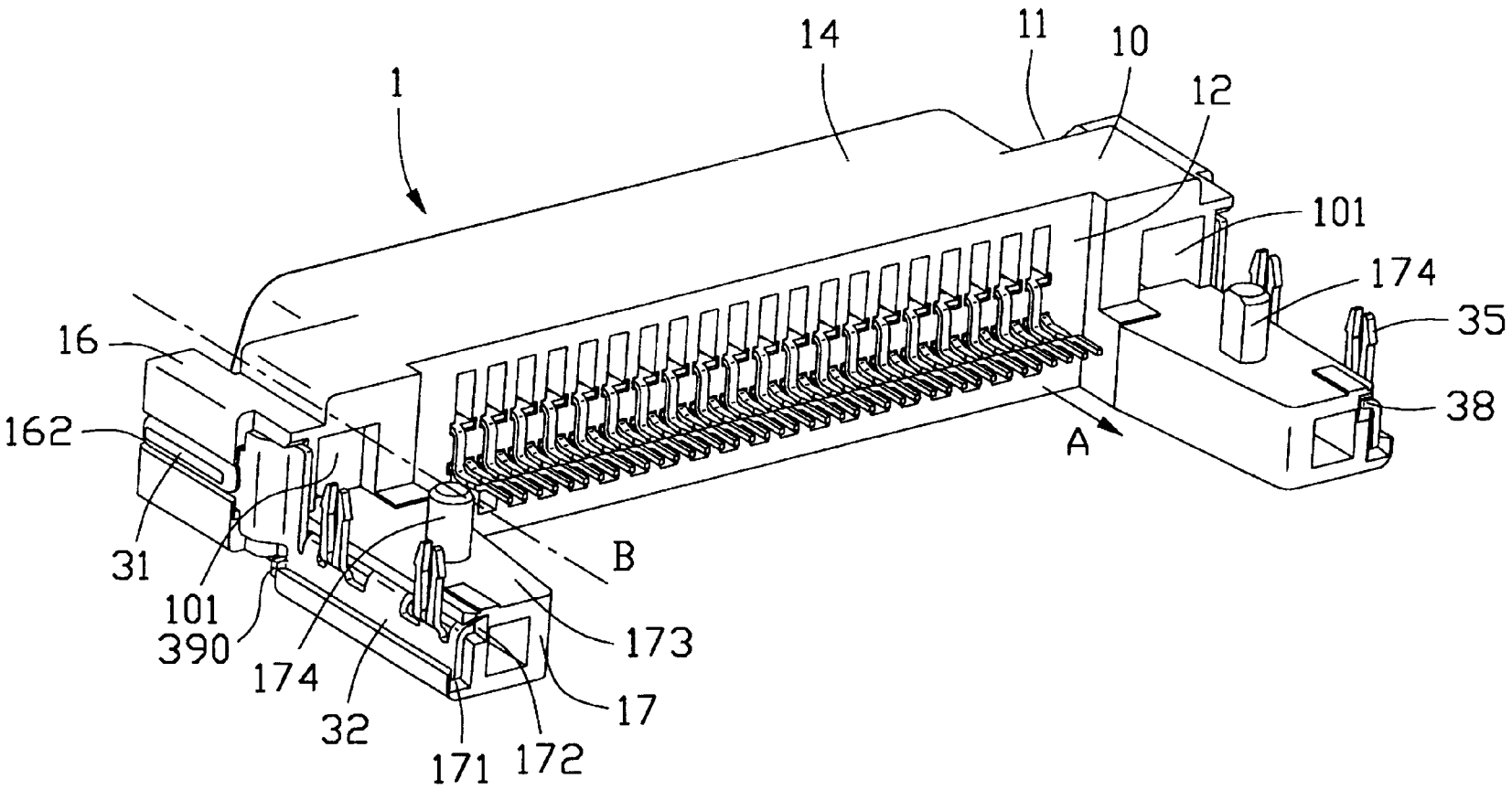
FIG. 3 is a bottom, perspective view of the electrical connector in accordance with the present invention.
Figure 4:
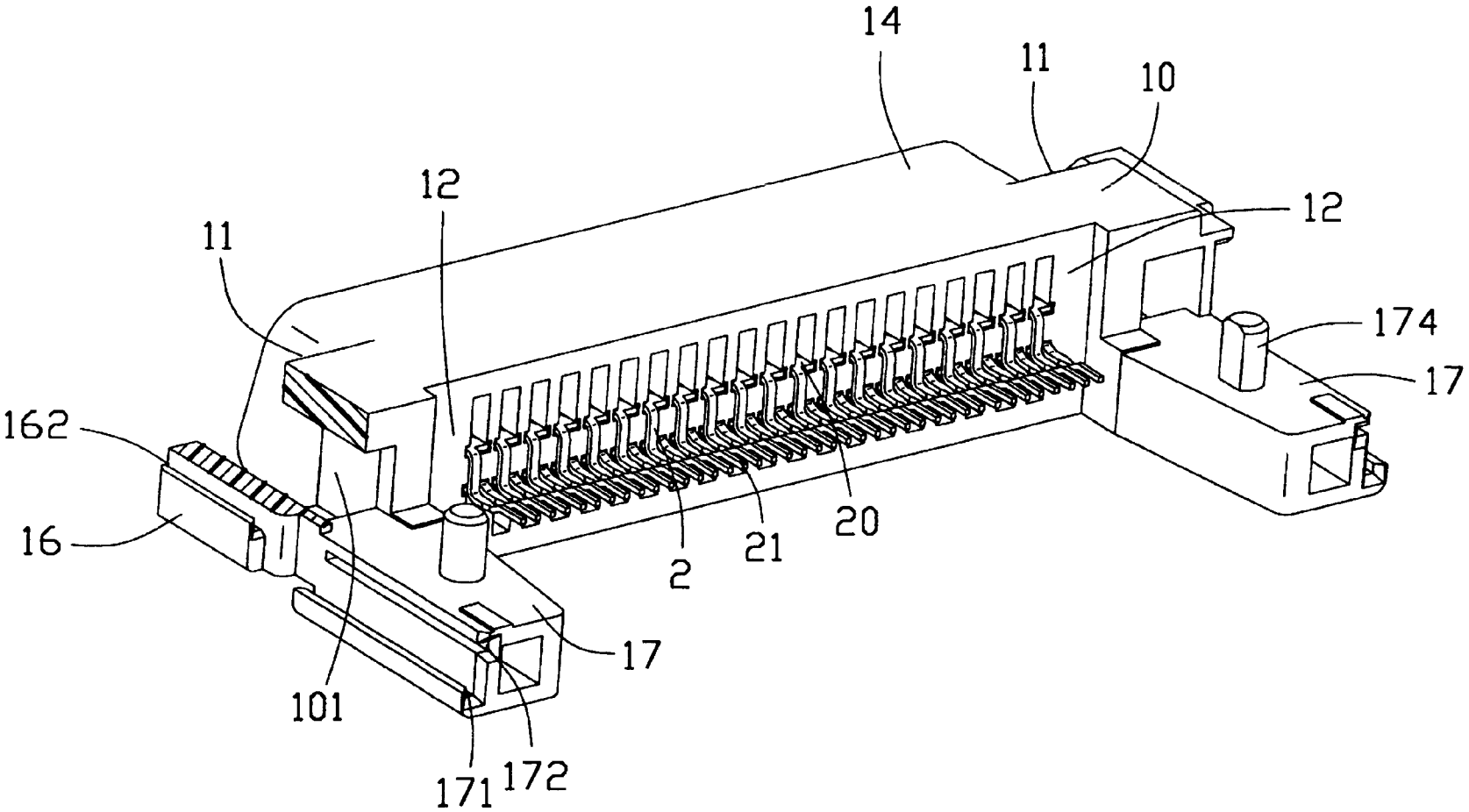
FIG. 4 is a view similar to FIG. 3 but with the grounding bridge removed and with parts of the housing removed to illustrate a core pin opening.

Referring to FIG. 3, each engagement arm 17 has an bottom surface 173. A substantially cylindrical post 174 is formed on the bottom surface 173 of each arm 17. The posts 174 are adapted to be mounted on a PCB (not shown) for fixing the housing 1 at certain position. A pair of opposite core pin openings 101 is formed in two ends of the base 10 near the engagement arms 17 and in front of the posts 174. The opening 101 extends through the front face 11 to the rear face 12. The core pin opening 101 and the post 174 is aligned in a direction indicated by a line B which extends in a direction parallel to the direction in which the passageways 15 extend.

Figure 2:
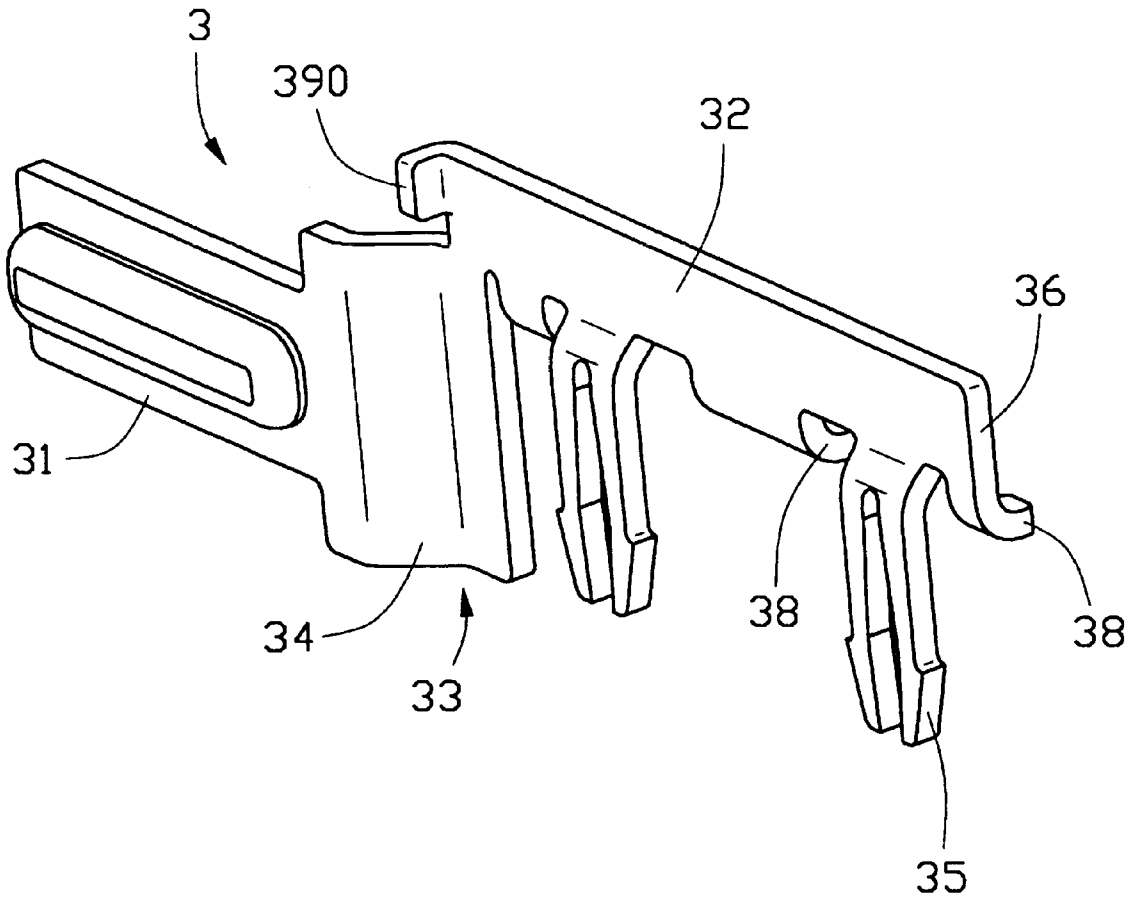
FIG. 2 is a perspective view of a grounding bridge.

A grounding bridge constructed in accordance with the present invention is designated 3 and illustrated in FIG. 2. The grounding bridge 3 is preferably stamped and formed from a sheet of metal, and it is preferred to use highly conductive and easily-soldered metals, such as copper with an appropriate plating material. The grounding bridge 3 comprises first and second leg portions 31, 32, which are spaced apart from and extend away from each other as illustrated. The two leg portions 31, 32 are joined together as shown and are interconnected by an intermediate portion 33. A part of the intermediate portion 33 is curved to define an offset 34 in the formed grounding bridge 3.

The first leg portion 31 extending from the intermediate portion 33 is dimensioned to interferentially engage into the mounting channel 162. The second leg portion 32 comprises two forklike board locks 35 for resiliently press fitting into an aperture in the PCB. The second leg portion 32 further comprises a web 36 and a plurality of first flanges 38 and a second flange 390. The plurality of first flanges 38 extends in a direction transverse to a longitudinal axis of the board lock 35. The board locks 35 are spaced from a plane defined by the web 36. The first flanges 38 extend outwardly of the plane of the web 36 and are transverse to the plane of the web 36 for engaging into the groove 172. The second flange 390 extends outwardly of the plane of the web 36 in a direction opposite to that of the first flange 38.

Each contact 2 has a receptacle contact end 20 received in the passageway 15 and a soldering end 21 extending out of the housing 1 and bent to be flush with the bottom surface 173 of the engaging arm 17. When the posts 174 are engaged in a position hole of the PCB, the soldering ends 21 of the contacts are aligned on the PCB for facilitating soldering operation.

The grounding bridges 3 are engaged in the housing 1. The first leg portion 31 extends into and is interferentially engaged with the mounting channel 162 for preventing disengagement of the grounding bridge 3 in both lateral and vertical directions. The second leg portion 32 is engaged with the engaging arm 17. The first flanges 38 are received into and interfere with the groove 172. The web 36 is received into the groove 171. As is best shown in FIG. 3, the second flange 390 abuts against a front face of the engaging arm 17 for preventing a rearward movement of the grounding bridge 3. Since the two leg portions 31, 32 of the grounding bridge 3 are spaced apart from each other and engaged securely with different parts of the housing 1, it is not easy for the grounding bridge 3 to de deformed by unexpected external force.

The housing 1 is formed by molding operation. The core pin opening 101 and the post 174 are aligned in a direction the passageways 15 extend. The post 174 is formed by a pair of core pins (not shown). When the post 174 is formed, the core pins are removed in a direction parallel to the direction that the passageways 15 extend and thus leave the core pin opening 101. In other words, because of the core pin opening 101 is designedly and allowably formed in the base 10, the post 174 can be directly formed, in insertion molding, by one of said pair of core pins which extends through said opening 101 and reaches the post 174. The removal direction of the core pins is the same as that of the main molds forming the rest portion of the housing 1, thereby facilitating molding operation. In opposite, because of lacking such an opening in the base in alignment with the post, the conventional connectors with the posts thereof, are required to use slide molds, which are operated in the direction perpendicular to the operation direction of the main molds, to form the posts. Understandably, in the presently preferably embodiment the opening 101 is dimensioned large enough to be bigger than the post 174, which is aligned in the front-to-back direction of the housing, in both the vertical direction and the lengthwise direction of the housing so that vertical projection of the post 174 on the base is fully embedded within the opening 101.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mounting on a printed circuit board (PCB), comprising:

a housing having a front face, a rear face, a plurality of passageways, two opposite engaging arms extending rearwardly from two opposite ends thereof, a pair of mounting channels on the two ends respectively, a first groove and a second groove each on an outer side of the respective engaging arm, each engaging arm having a post, an opening extending from the front face to the rear face, the opening and the post being aligned in a direction that the passageways extend;

a plurality of electrical contacts mounted in the passageways of the housing; and a pair of grounding bridges each comprising a web received in the second groove, a first leg portion interferingly engaging into a corresponding mounting channel, and a second leg portion joined to the first leg portion via an intermediate portion, the second leg portion having first and second flanges and board locks, the first flange engaging with the first groove and the second flange abutting against a front face of the engaging arm;

wherein the intermediate portion of the grounding bridge is curved;

wherein the first flange extends outwardly in a direction transverse to a longitudinal axis of the board lock and the plane of the web, and the second flange extends outwardly of the plane of the web;

wherein the engaging arm has a bottom surface and individual ends of the contacts extend outwardly from the housing and are bent to be flush with the bottom surface;

wherein the housing comprises two forwardly extending opposite alignment bars formed on respective opposite side walls thereof, each alignment bar having a pair of blocks each defining a slot, the slots communicating with each other to define the mounting channel.

* * * * *